US009334624B2

(12) United States Patent
Bradley et al.

(10) Patent No.: US 9,334,624 B2
(45) Date of Patent: May 10, 2016

(54) ARTICULATED WORK MACHINE

(75) Inventors: Nathan Bradley, Muscatine, IA (US); Matthew D. Wagenbach, Burlington, IA (US); Jason Mattice, Chicago, IL (US); Ronald C. Natzke, Burlington, IA (US); Ralph D. Galloway, Burlington, IA (US)

(73) Assignee: CNH Industrial America LLC, New Holland, PA (US)

( * ) Notice: Subject to any disclaimer, the term of this patent is extended or adjusted under 35 U.S.C. 154(b) by 551 days.

(21) Appl. No.: 13/554,522

(22) Filed: Jul. 20, 2012

(65) Prior Publication Data

US 2013/0051965 A1 Feb. 28, 2013

Related U.S. Application Data

(60) Provisional application No. 61/526,012, filed on Aug. 22, 2011.

(51) Int. Cl.
*E02F 3/38* (2006.01)
*E02F 3/96* (2006.01)

(52) U.S. Cl.
CPC .. *E02F 3/964* (2013.01); *E02F 3/38* (2013.01)

(58) Field of Classification Search
CPC ..... E02F 3/38; E02F 3/382; E02F 3/384; E02F 9/14; Y10S 414/131
USPC ..... 52/111, 116; 414/543, 680, 685, 686, 414/687, 691, 694, 695.5, 722, 723, 727, 414/918
See application file for complete search history.

(56) References Cited

U.S. PATENT DOCUMENTS

| | | | | |
|---|---|---|---|---|
| 4,162,872 | A | 7/1979 | Grooss et al. | |
| 4,260,322 | A | 4/1981 | Cameron | |
| 4,392,314 | A * | 7/1983 | Albrecht et al. | 414/694 |
| 5,152,659 | A * | 10/1992 | Waka | 414/722 |
| 5,611,657 | A | 3/1997 | Peterson | |
| 6,142,724 | A | 11/2000 | Hirooka et al. | |
| 6,158,949 | A | 12/2000 | Walth et al. | |
| 7,448,841 | B2 | 11/2008 | Ishikawa et al. | |
| 7,670,099 | B2 | 3/2010 | Nakajima et al. | |
| 7,762,758 | B2 * | 7/2010 | Sharpe et al. | 414/722 |
| 2008/0187427 | A1 | 8/2008 | Durney | |

FOREIGN PATENT DOCUMENTS

| | | | |
|---|---|---|---|
| JP | 2008050807 | A | 3/2008 |
| KR | 20090111930 | A | 10/2009 |

* cited by examiner

*Primary Examiner* — Ernesto Suarez
*Assistant Examiner* — Brendan Tighe
(74) *Attorney, Agent, or Firm* — Patrick M. Sheldrake

(57) ABSTRACT

An articulating member of a work machine includes a side plate of an opposed pair of side plates, each side plate of the pair of side plates having a surface facing the other side plate. At least one mount forming a pivot joint is secured to corresponding portions of each facing surface of a side plate of the pair of side plates. A separator plate is positioned between the pair of side plates. A reinforcement member has a peripheral edge collectively secured to one side plate surface, the at least one mount and the separator plate. The reinforcement member forms a continuous compartment spaced from the surface of the side plate, the peripheral edge forms a continuous connection with the one side plate surface, the at least one mount and the separator plate, and the at least one mount is fully secured to the one side plate surface.

11 Claims, 8 Drawing Sheets

ARTICULATED WORK MACHINE

CROSS-REFERENCE TO RELATED APPLICATIONS

This application claims the benefit of U.S. Provisional Application No. 61/526,012, entitled "ARTICULATED WORK MACHINE," filed Aug. 22, 2011, which application is hereby incorporated by reference in its entirety.

FIELD OF THE INVENTION

This invention relates generally to a work machine, and more particularly to an articulated work machine having reinforced joints and corresponding structural members configured to provide an extended endurance life, while adding minimal weight.

BACKGROUND OF THE INVENTION

Articulated work machines, such as a loader backhoe, also referred to as a backhoe, are commonly used on job sites. Mounts formed in the backhoe boom that are secured to hydraulic cylinders transfer large loads to the backhoe structure. These mounts are subject to premature failure.

Accordingly, it would be desirable for a boom construction capable of withstanding increased loads while increasing the endurance life associated with such loads, with minimal weight increase of the boom.

SUMMARY OF THE INVENTION

The present invention relates to an articulating member of a work machine including a side plate of an opposed pair of side plates, each side plate of the pair of side plates having a surface facing the other side plate. At least one mount forming a pivot joint is secured to corresponding portions of each facing surface of a side plate of the pair of side plates. A separator plate is positioned between the pair of side plates. A reinforcement member having a peripheral edge is collectively secured to one side plate surface, the at least one mount and the separator plate. The reinforcement member forming a continuous compartment is spaced from the surface of the side plate, the peripheral edge forming a continuous connection with the one side plate surface, the at least one mount and the separator plate, and the at least one mount fully secured to the one side plate surface.

The present invention further relates to a work machine including an articulating member. The articulating member includes a side plate of an opposed pair of side plates, each side plate of the pair of side plates having a surface facing the other side plate. At least one mount forming a pivot joint is secured to corresponding portions of each facing surface of a side plate of the pair of side plates. A separator plate is positioned between the pair of side plates. A reinforcement member having a peripheral edge is collectively secured to one side plate surface, the at least one mount and the separator plate. The reinforcement member forms a continuous compartment spaced from the surface of the side plate, the peripheral edge forming a continuous connection with the one side plate surface, the at least one mount and the separator plate, and the at least one mount fully secured to the one side plate surface.

The present invention further relates to a method for assembling an articulating member for a work vehicle. The method includes providing a pair of opposed side plates, each side plate of the pair of side plates having a surface facing the other side plate. The method further includes providing at least one pair of mounts collectively forming a pivot joint, each mount to be secured to a corresponding portion of one facing surface of a side plate of the pair of side plates. The method further includes providing a separator plate positioned between the pair of side plates. The method further includes providing a pair of reinforcement members each having a peripheral edge, each reinforcement member to be collectively secured to one side plate surface facing the other side plate, the at least one mount and the separator plate. The method further includes welding each mount of the at least one pair of mounts to a corresponding portion of a surface of a side plate of the pair of side plates. The method further includes welding the separator plate to each of the side plates and a corresponding mount of the at least one pair of mounts. The method further includes collectively welding each reinforcement member to a corresponding mount of the at least one pair of mounts and to a corresponding portion of a surface of each of the side plates and to a corresponding portion of the separator plate. Each reinforcement member forms a continuous compartment spaced from the surface of the corresponding side plate, each peripheral edge forming a continuous connection with the one corresponding side plate surface, the at least one mount and the separator plate, and the periphery of the at least one mount welded to the one corresponding side plate surface.

An advantage of the present invention is a reinforced structure that adds little weight.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
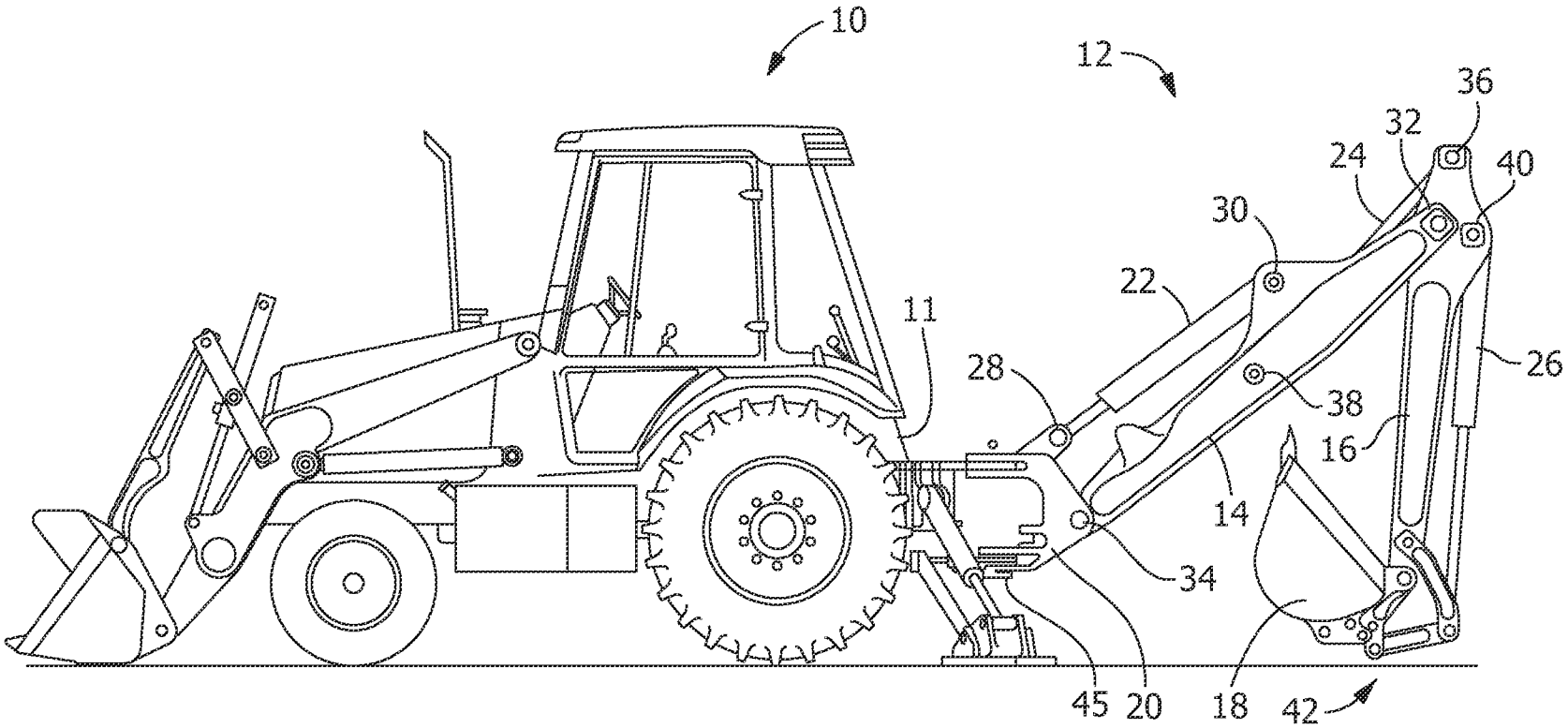
FIG. 1 is a side view of an embodiment of a work machine.

Referring to the drawings for a description of an articulated earthworking machine 10, sometimes referred to as an excavator or loader backhoe, that employs the present invention, FIG. 1 shows an articulating member or a third portion or boom 14 in a lowered position. Boom 14 pivots about a pivot joint 34 and coincident pivot axis of a second portion or swing frame or frame 20 and is controlled by extension/contraction of a fluid ram 22 connected between pivot joints 28, 30. Frame 20 pivots about a pivot joint 45 with respect to a first portion or base frame 11 of the machine. Similarly, an articulating member or arm 16, often referred to as a dipper, pivots about pivot joint 32 of boom 14 and is controlled by extension/contraction of fluid ram 24 connected between pivot joints 36, 38. In addition, attachment or implement 18, such as a bucket, is pivotably connected to arm 16 and is controlled by extension/contraction of a fluid ram 26 connected between pivot joint 40 and interconnected linkages 42. A backhoe 12 comprises the combination of boom 14, arm 16, implement 18 and pivoting connections therebetween.

As used herein, the term articulated, as in articulated machine, indicates that the machine includes articulations, articulating or pivotable or pivot joints or connections, which terms may be used interchangeably.

Figure 2:
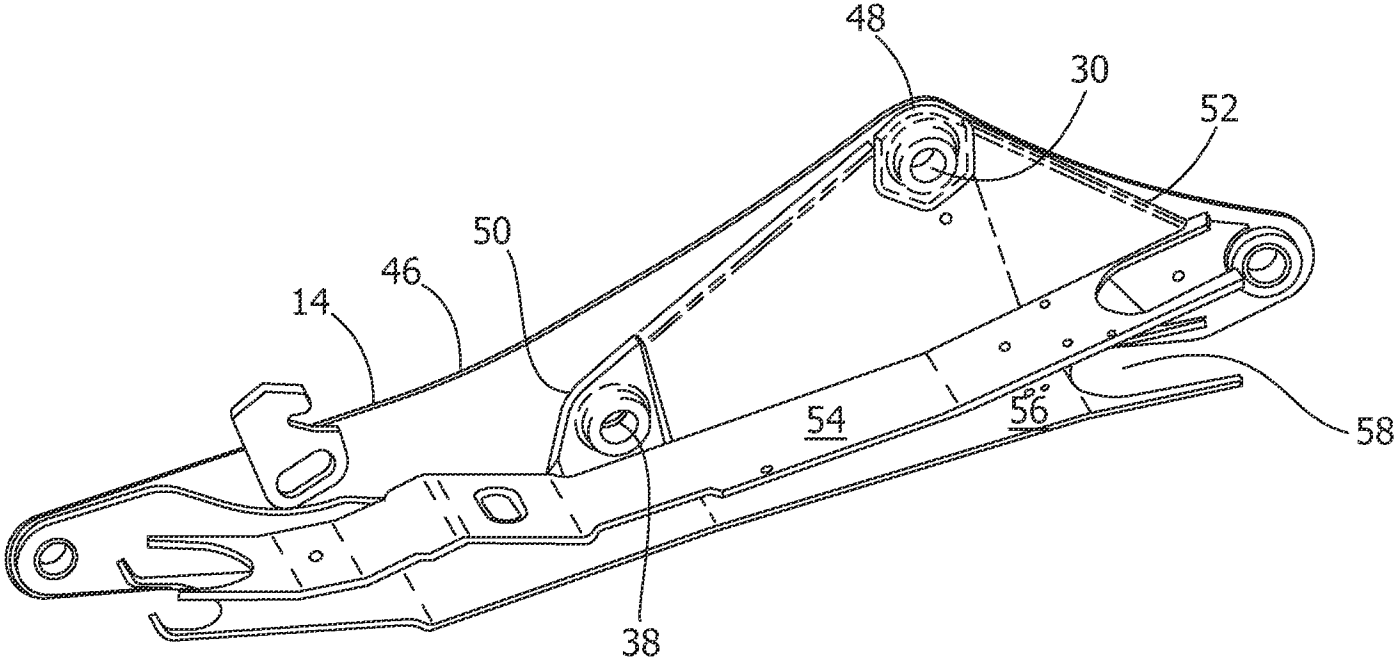
FIG. 2 is an upper perspective view of a boom of the work machine of FIG. 1 with a side plate removed.

FIG. 2 shows boom 14, with a side plate 46 not shown for clarity, a pair of opposed side plates 46 defining exterior opposed surfaces of boom 14. A first separator plate 54 and a second separator plate 56 extend substantially longitudinally along boom 14 defining a passageway 58 between opposed side plates 46 through which extend hydraulic lines and other plumbing or components (not shown) through or positioned inside boom 14. Pivot joint 30 is formed in a boom cylinder mount 48 secured to side plate 46 and reinforcement member 52, such as a plate. Similarly, pivot joint 38 is formed in a dipper cylinder mount 50 secured to side plate 46 and reinforcement member 52. It is to be understood that a boom cylinder mount 48, dipper cylinder mount 50, and reinforcement member 52 also correspond to the side plate not shown in FIG. 2.

Figure 3:
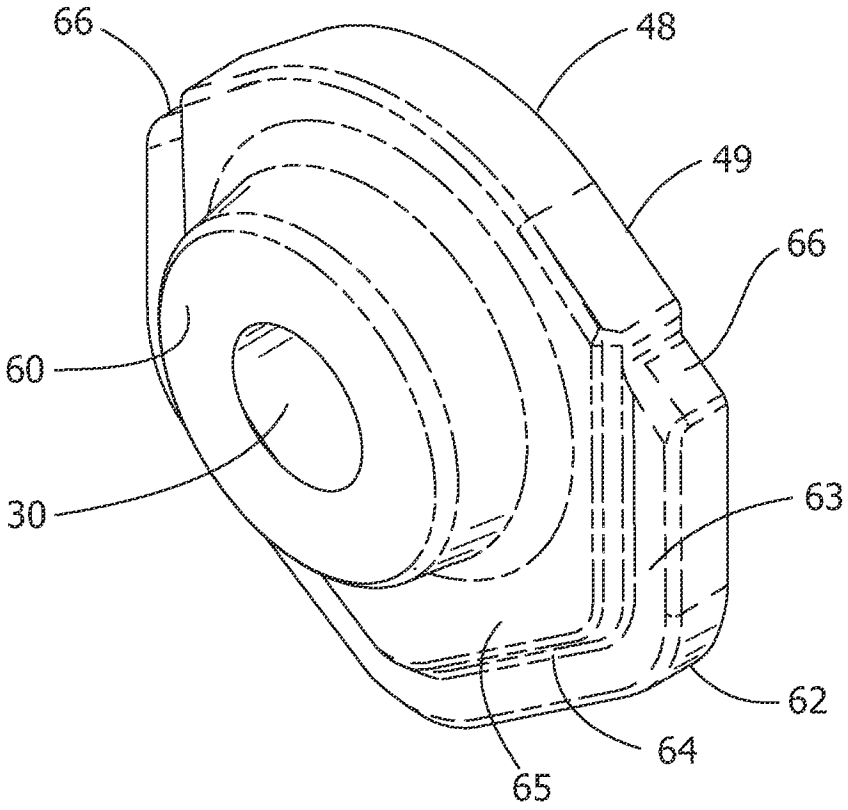
FIG. 3 is an upper perspective view of an exemplary boom cylinder mount.

FIG. 3 shows boom cylinder mount 48 including a back surface 49 that is secured to side plate 46 (FIG. 2). Boom cylinder mount 48 further includes a cylindrical boss 60 through which is formed pivot joint 30. In addition, boom cylinder mount 48 further includes a first stepped region 62 defining a substantial portion of the outer periphery of boom cylinder mount 48, with first stepped region 62 having a supporting first surface 63 that is substantially parallel to back surface 49. A pair of notches 66 separate first stepped region 62 from the remaining portion of the outer periphery of boom cylinder mount 48. Proceeding inwardly along supporting first surface 63 toward cylindrical boss 60, supporting first surface 63 transitions to a second stepped region 64 having a second surface 65 that is substantially parallel to back surface 49. In one embodiment, boom cylinder mount 48 can be a forging, while in another embodiment boom cylinder mount 48 can be a casting.

Figure 4:
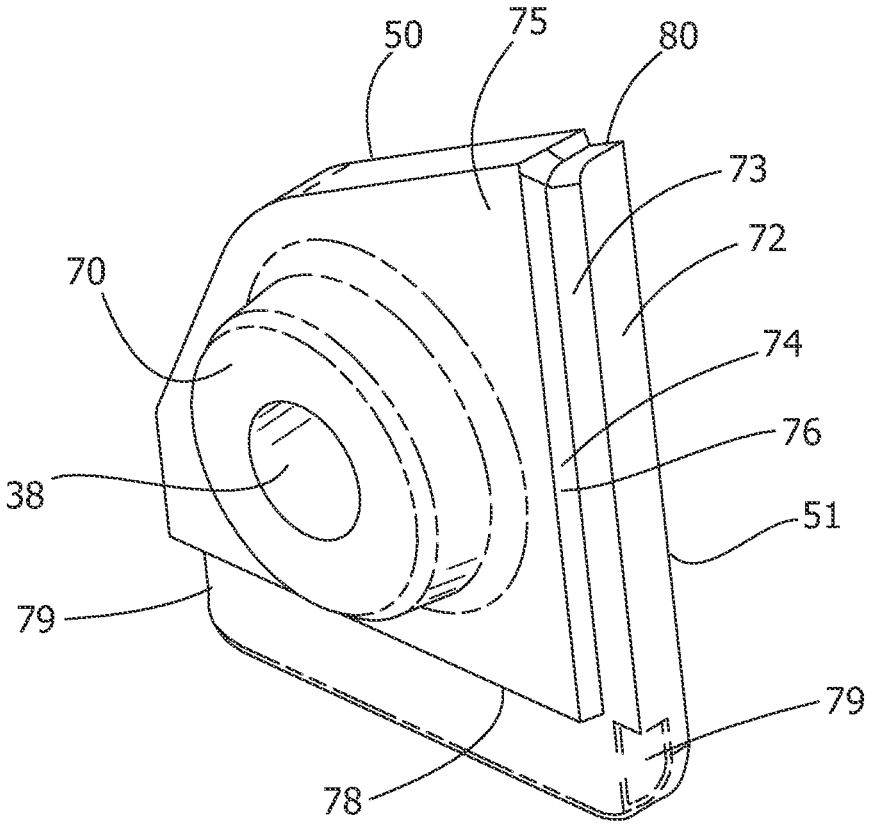
FIG. 4 is an upper perspective view of an exemplary dipper cylinder mount.

FIG. 4 shows dipper cylinder mount 50 including a back surface 51 that is secured to side plate 46 (FIG. 2). Dipper cylinder mount 50 further includes a cylindrical boss 70 through which is formed pivot joint 38. In addition, dipper cylinder mount 50 further includes a third stepped region 72 defining a substantial portion of the outer periphery of dipper cylinder mount 50, with third stepped region 72 having a supporting third surface 73 that is substantially parallel to back surface 51. A notch 80 forms a discontinuity at one end of third stepped region 72, with a pair of notched corners 79 formed at opposed ends of third stepped region 72. Proceeding inwardly along supporting third surface 73 toward cylindrical boss 70, supporting third surface 73 transitions to a fourth stepped region 74 having a fourth surface 75 that is substantially parallel to back surface 51. One portion of fourth stepped region 74 includes an edge 76, with an adjacent portion of fourth stepped region 74 including an edge 78. In one embodiment dipper cylinder mount 50 can be a forging, while in another embodiment dipper cylinder mount 50 can be a casting.

Figure 5:
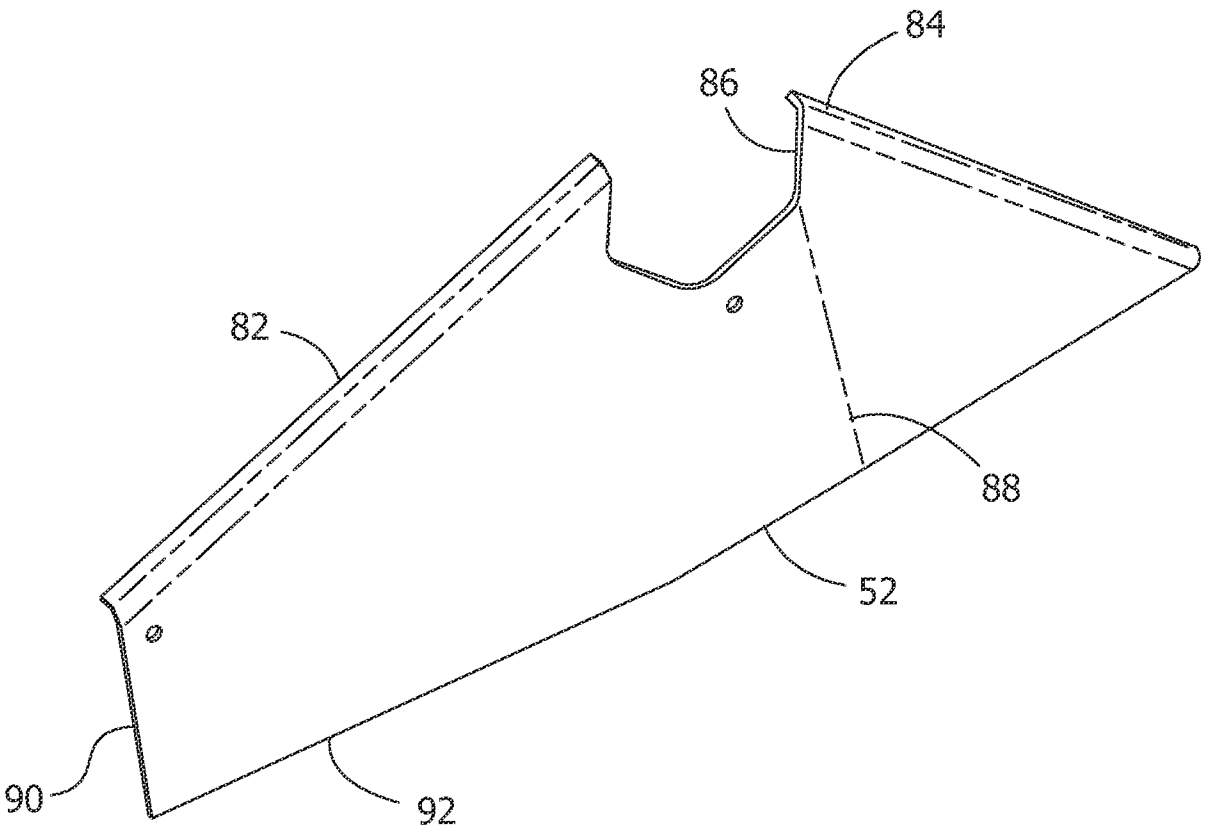
FIG. 5 is an upper perspective view of a boom reinforcement member.

FIG. 5 shows a reinforcement member 52 including an opening 86 configured to receive boom cylinder mount 48 (FIG. 3), a first angled flange 82 and a second angled flange 84 formed along adjacent sides of reinforcement member 52. First angled flange 82 extends between opening 86 and a first edge 90. Reinforcement member 52 includes a second edge 92 configured to abut a surface of first separator plate 54 (FIG. 2). Opening 86, first angled flange 82, second angled flange 84, first edge 90 and second edge 92 collectively represent a peripheral edge of reinforcement member 52. Optionally, a bend 88 can be formed in reinforcement member 52, such as for reasons of providing additional space between corresponding side plates 46 (FIG. 2) without removing second angled flange 84. In one embodiment, with the exception of bend 88, first angled flange 82 and second angled flange 84, reinforcement member 52 may be substantially planar.

Figure 6:
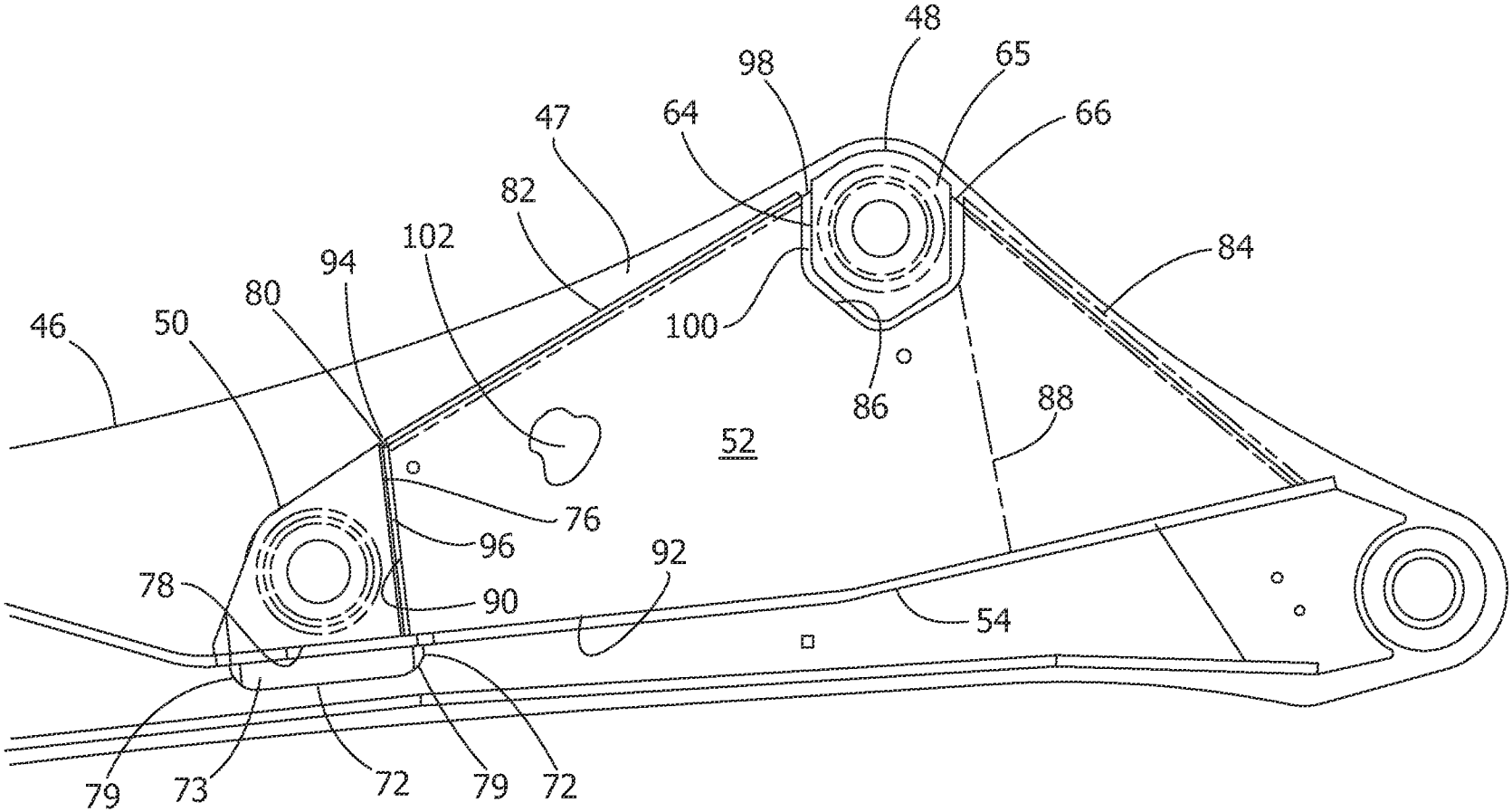
FIGS. 6-8 are enlarged, different views of the boom of FIG. 2.
Figure 7:
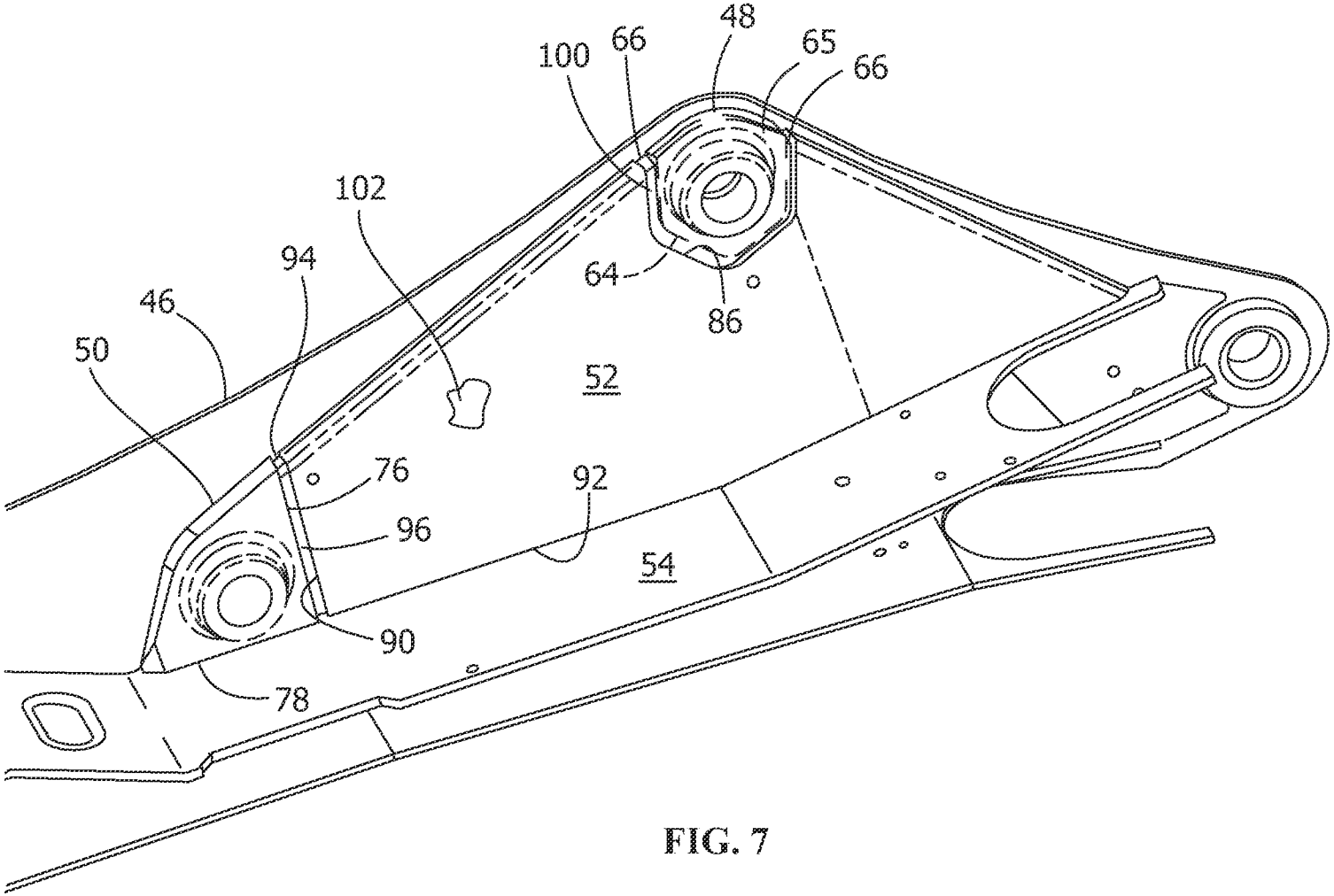
Figure 8:
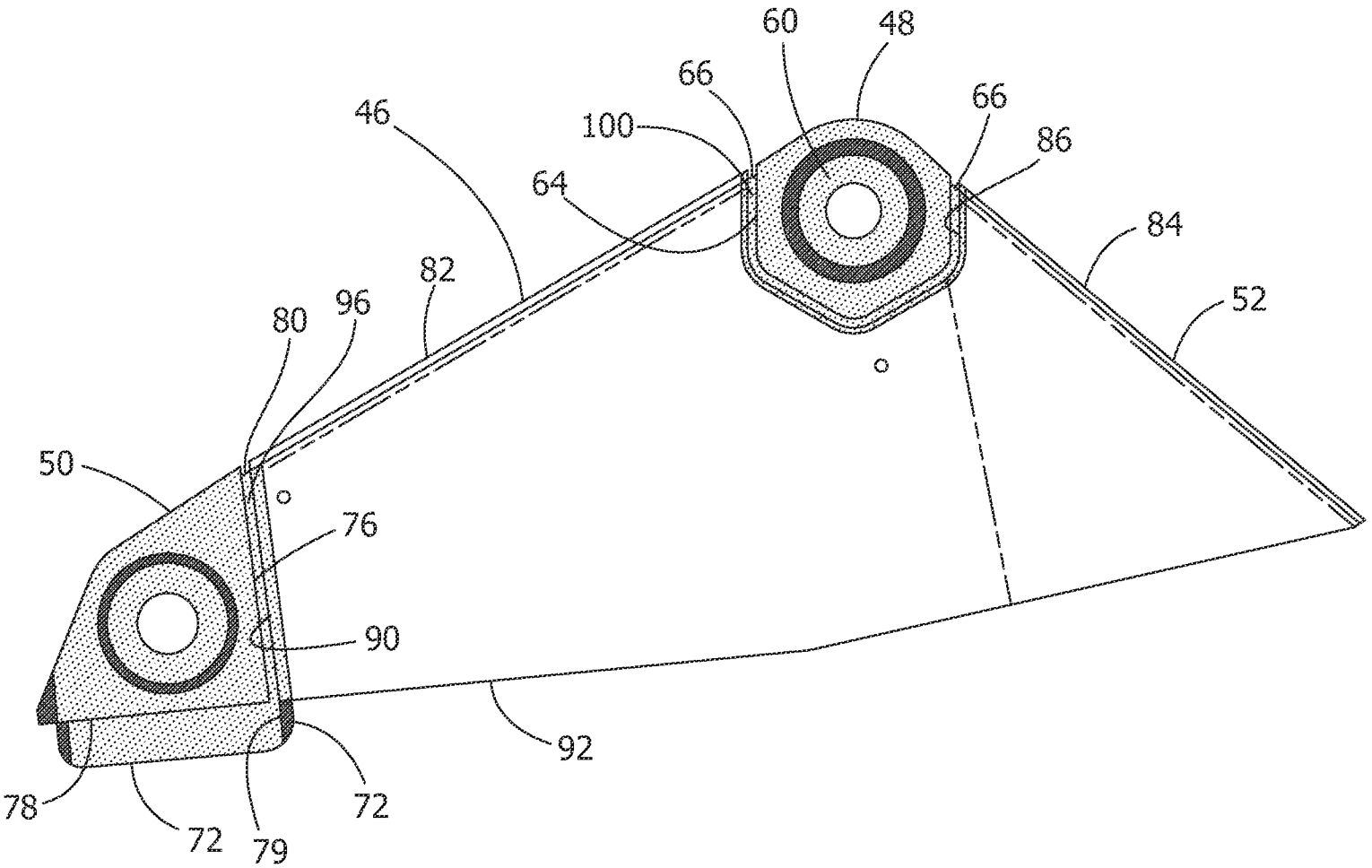

FIGS. 3, 4 show features of cylinder mounts 48, 50 and FIGS. 6-8 show different enlarged partial views of reinforcement member 52 assembled to side plate 46, boom cylinder mount 48, dipper cylinder mount 50 and first separator plate 54. Boom cylinder mount 48 may be secured to side plate 46 by a fillet weld formed about the entire outer periphery of boom cylinder mount 48, minus notches 66 formed in boom cylinder mount 48. Similarly, dipper cylinder mount 50 may be secured to side plate 46 by a fillet weld formed about the entire outer periphery of dipper cylinder mount 50, minus notch 80 and a region adjacent notched corner 79 facing away from reinforcement member 52 (FIG. 6) formed in dipper cylinder mount 50. One skilled in the art would note that forming fillet welds in the respective notches 66, 80 prior to installation of reinforcement member 52 would prevent reinforcement member 52 from making abutting contact with respective supporting first surface 63 of boom cylinder mount 48 and supporting third surface 73 of dipper cylinder mount 50. Similarly, in the exemplary embodiment as shown in FIG. 6, forming a fillet weld adjacent notched corner 79 facing away from reinforcement member 52 of dipper cylinder mount 50 prior to installation of first separator plate 54 would prevent first separator plate 54 from making abutting contact with a corresponding portion of dipper cylinder mount 50. Upon placement of reinforcement member 52 such that opening 86 of reinforcement member 52 is in abutting contact with supporting first surface 63 of first stepped region 62 of boom cylinder mount 48, first edge 90 of reinforcement member 52 is in abutting contact with supporting third surface 73 of third stepped region 72, and second edge 92 of reinforcement member 52 is in close proximity with or in abutting contact with a facing surface of first separator plate 54, reinforcement member 52 may be secured. That is, a fillet weld may be formed between first angled flange 82 of reinforcement member 52 and a surface 47 of side plate 46 between cylinder mounts 48, 50. A full penetration weld 100 between reinforcement member 52 and second stepped region 64 of cylinder mount 48 is formed between a gap 98 separating opening 86 of reinforcement member 52 and second stepped region 64 of cylinder mount 48. Fillet welds are also formed between side plate 46 and respective second angled flange 84 and end 92 of reinforcement member 52. A full penetration weld 96 between reinforcement member 52 and edge 76 of fourth stepped region 74 of cylinder mount 50 is formed between a gap 94 separating first edge 90 of reinforcement member 52 and fourth stepped region 74 of cylinder mount 50.

As shown, upon completion of the welds, reinforcement member 52 contains welds that completely surround the periphery or outer periphery of reinforcement member 52 to respective surfaces of cylinder mounts 48, 50, surface 47 of side plate 46 and first separator plate 54. Similarly, upon installation of reinforcement member 52, cylinder mounts 48, 50 contain welds that completely surround the periphery or outer periphery of each of the cylinder mounts. Reinforcement member 52 forms a continuous compartment 102 spaced from surface 47 of side plate 46. That is, compartment 102 does not need to contain baffles or other types of supports that would otherwise require openings formed in reinforcement member 52 in order to secure the baffles or supports between side plate 46 and reinforcement member 52 by welding or other fabrication technique. In addition, cylinder mounts 48, 50, reinforcement member 52, and a corresponding side of first separator plate 54 may be secured to each other as described previously, with access to only surface 47 of side plate 46, which greatly simplifies the fabrication process. That is, access to the surface opposite surface 47 of side plate 46 is not required in order to secure cylinder mounts 48, 50, reinforcement member 52 and the corresponding side of first separator plate 54 to each other. This combination of outer peripheral welds with reinforcement member 52 provides improved load-bearing capabilities associated with the boom, as well as significantly improved fatigue properties. That is, not only can the boom support greater structural loads during operation, but the cylinder mounts 48, 50, as well as other portions of the boom can support these greater loads for a significantly longer period of time than was previously possible. In addition, a minimal weight increase is associated with the exemplary arrangement reinforcement member 52.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An articulating member of a work machine comprising a side plate of an opposed pair of side plates, each side plate of the pair of side plates having a surface facing the other side plate;

at least one mount forming a pivot joint secured to corresponding portions of each facing surface of a side plate of the pair of side plates, said at least one mount having a thickness and a stepped region spaced from said side plate;

a separator plate positioned between and secured to the pair of side plates; and a reinforcement member in form of a plate that has a flat surface having an edge with an opening configured to abut the stepped region of said at least one mount, the reinforcement member having a peripheral edge collectively secured to one side plate surface, the at least one mount and the separator plate;

wherein the reinforcement member forms a continuous compartment spaced from the surface of the side plate, the peripheral edge forming a continuous connection with the one side plate surface, the at least one mount and the separator plate, and the at least one mount fully secured to the one side plate surface.

2. The articulating member of claim 1, having a pair of mounts interconnected by said reinforcement member.

3. The articulating member of claim 1, wherein the supporting surface of the at least one mount is adjacent to a second stepped region forming a gap between a corresponding portion of the peripheral edge of the reinforcement member.

4. The articulating member of claim 3, wherein the gap permits formation of a full penetration weld between the at least one mount and the reinforcement member.

5. The articulating member of claim 2, wherein said reinforcement member has a bent portion in between said pair of mounts abutting and secured to said side plate.

6. The articulating member of claim 1, wherein the work machine is a loader backhoe.

7. A work machine comprising an articulating member comprising a side plate of an opposed pair of side plates, each side plate of the pair of side plates having a surface facing the other side plate;

at least one mount forming a pivot joint secured to corresponding portions of each facing surface of a side plate of the pair of side plates, said at least one mount having a thickness and a stepped region spaced from said side plate;

a separator plate positioned between and secured to the pair of side plates; and a reinforcement member in form of a plate with a flat surface and edge with an opening configured to abut the stepped region of said at least one mount, the reinforcement member having a peripheral edge collectively secured to one side plate surface, the at least one mount and the separator plate;

wherein the reinforcement member forms a continuous compartment spaced from the surface of the side plate, the peripheral edge forming a continuous connection with the one side plate surface, the at least one mount and the separator plate, and the at least one mount fully secured to the one side plate surface.

8. The articulating member of claim 7, having a pair of mounts interconnected by said reinforcement member.

9. The articulating member of claim 7, wherein the supporting surface of the at least one mount is adjacent to a second stepped region forming a gap between a corresponding portion of the peripheral edge of the reinforcement member.

10. The articulating member of claim 9, wherein the gap permits formation of a full penetration weld between the at least one mount and the reinforcement member.

11. The articulating member of claim 8, wherein said reinforcement member has a bent portion in between said pair of mounts abutting and secured to said side plate.

* * * * *